US006070395A

United States Patent [19]

Calvano

[11] Patent Number: 6,070,395

[45] **Date of Patent: *Jun. 6, 2000**

[54] METHOD FOR JOINT PACKAGING OF BAGS AND THEIR CONTENTS AND MACHINE FOR PERFORMING SUCH METHOD

[75] Inventor: Ferruccio Carmelo Calvano, Buenos Aires, Argentina

[73] Assignee: Mainar, S.A., Argentina

[ * ] Notice: This patent issued on a continued prosecution application filed under 37 CFR 1.53(d), and is subject to the twenty year patent term provisions of 35 U.S.C. 154(a)(2).

[21] Appl. No.: 08/780,360

[22] Filed: Jan. 9, 1997

[30] Foreign Application Priority Data

Jan. 10, 1996 [AR] Argentina ..... 334986

[51] Int. Cl.[7] ..... B65B 9/10

[52] U.S. Cl. ..... 53/451; 53/171; 53/439; 53/447; 53/526; 53/529; 53/540; 53/551; 53/552

[58] Field of Search ..... 53/171, 248, 244, 53/245, 437, 438, 439, 447, 449, 451, 469, 475, 525, 526, 527, 529, 535, 540, 551, 552

[56] References Cited

U.S. PATENT DOCUMENTS

| | | | |
|---|---|---|---|
| 2,682,216 | 6/1954 | Shields | 53/526 X |
| 3,581,876 | 6/1971 | Keith | 53/526 X |
| 3,641,735 | 2/1972 | Daily et al. | 53/540 X |
| 3,766,706 | 10/1973 | Graham | 53/260 X |
| 3,959,951 | 6/1976 | Paules | 53/157 |
| 4,027,460 | 6/1977 | Orr | 53/575 |
| 4,045,940 | 9/1977 | White et al. | 53/540 X |
| 4,791,776 | 12/1988 | Jackman et al. | 53/248 X |
| 5,029,431 | 7/1991 | Weening et al. | 53/437 |
| 5,117,614 | 6/1992 | Johnsen | 53/248 X |
| 5,127,212 | 7/1992 | Johnsen et al. | 53/540 |
| 5,284,003 | 2/1994 | Goodman et al. | 53/437 |
| 5,313,766 | 5/1994 | Rimondi et al. | 53/451 |

*Primary Examiner*—Daniel B. Moon
*Attorney, Agent, or Firm*—Bracewell & Patterson, L.L.P.

[57] ABSTRACT

Bags containing a particle, powder or granule product are packed inside a wrapper formed from an elongated laminar wrapping of thermo-bonding plastic. The wrapping is sealed along longitudinal seams to form a sleeve. The bags of product are advanced on a transporter and pressed to a compact and even shape. A first bag is placed on a temporary support and the wrapping formed into a sleeve about the bag. The first bag is allowed to fall into the sleeve. The sleeve and bag are caused to ascend at the same time, and the sleeve is closed with seams during its descent. The process is then repeated for successive bags until the sleeve contains a set number of bags. The sleeve is then closed into a welded wrapping about the bags.

10 Claims, 9 Drawing Sheets

METHOD FOR JOINT PACKAGING OF BAGS AND THEIR CONTENTS AND MACHINE FOR PERFORMING SUCH METHOD

I. FIELD OF THE INVENTION

This invention relates to a method for performing joint packaging of bags and the contents thereof, and it also relates to the machine used to carry out said method.

In the packaging industry, one of the most well known ways to sell powder and granule products is through fractioning and packaging in paper bags or plastic bags; the latter are preferred as they are stronger, more permeable and extremely airtight. However, as particle products and finely divided products behave in a similar way as liquids, because the laminar packaging is flexible, said package deforms because of the movement and weight of the contents. This is why large quantities are difficult to store, transport and handle.

Therefore, it is necessary to provide the joint packaging of bags, this is generally done by means of boxes; said boxes can be used when selling to wholesalers, retailers and dealers of the bag-packaged products.

The use of boxes is, no doubt, advantageous, though as cardboard is hygroscopic, oftentimes it causes decay of the goods as humidity may affect said goods. Moreover, cardboard is expensive, and it is advisable to use materials which are cheaper and more waterproof.

For a long time, new methods and machines have been necessary for providing bags for special products in plastic bags; but many difficulties arose which even today make this kind of bag-packaging difficult, as for example, the deformation of the package itself, because of the movement of the contents thereof, the frailty of the bag walls so that it is not safe to use machines to handle them, etc.

Thus, there are available tube-like plastic packages, closed at one end, which are manually loaded, whose other end is then closed in order to define the package.

This process, apart from being slow and expensive, is complex since as bags are filled their shape and size change; so when they are filled manually, if the sleeve is tight, the bag folds produce an uneven bellows (which leads to conditioning), whereas if the sleeve is loose, the goods are not well conditioned and may break.

The object of the present invention comprises a new packaging method for bags in a plastic laminar packaging, by means of the use of a completely automated, high-performing and safe machine, which helps reduce the remarkably high cost of the packaging methods, and improves production.

Moreover, the resulting packaging defines more or less plane bottoms which make it possible for the package to stand, and therefore, they are easier to store in warehouses, deposits or means of transport.

Also, the machines embodies two different versions of one concept:

a) the transport of bags from the station or receiving area to the sleeve, is carried out through gravity (applicable, for example, to bags containing granule products or grains, such as rice, legumes etc.) and b) a controlled and gradual fall where each bag is taken by a mechanism, and then placed inside a packaging sleeve; the latter is appropiate when the bag contains liquids, such as milk or similar.

For all the above mentioned reasons, it is easy to conclude that this invention will be welcomed once it is embodied, no matter its final use, since because of the features thereof, it can be used for packaging grains, particle materials such as sugar, corn flour, wheat flour, granules, gels, medicinal herbs, etc.

II. ILLUSTRATION

For a better understanding and for the sake of clarity, this invention is illustrated in the figures below where one of the preferred embodiments is shown. Said illustrations are not limiting, and are included by way of illustration only.

this figure also shows the welding and cutting jaws in an open position.

Figure 7:
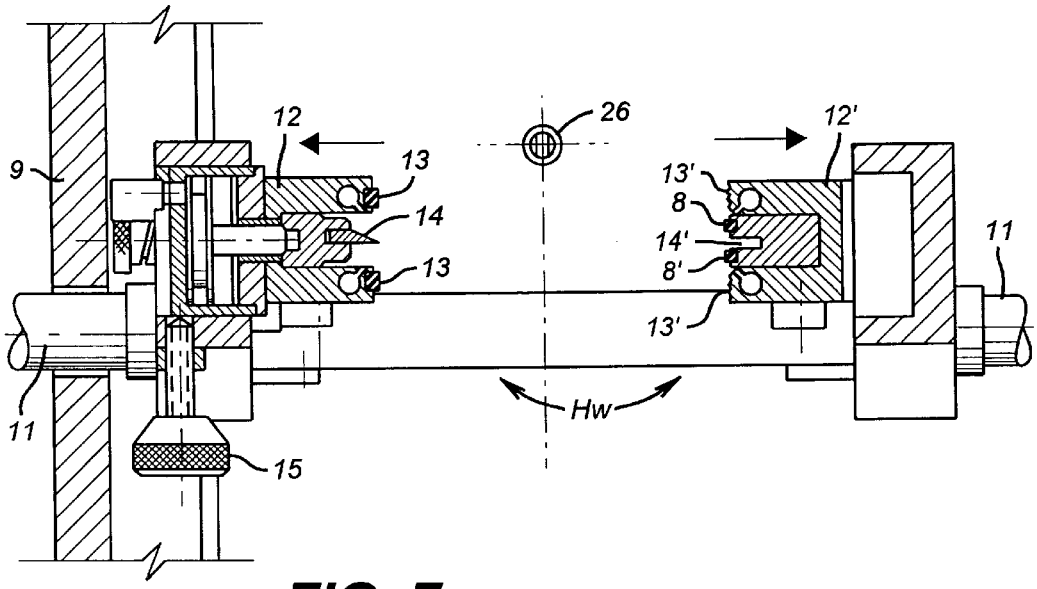
FIG. 7 shows another detail of the machine, showing a cross-section of the horizontal welding system.
Figure 8:
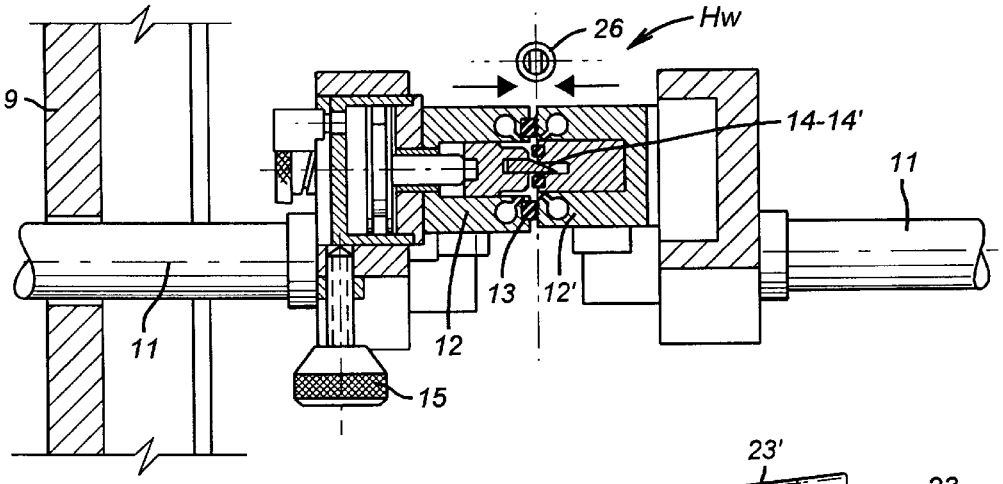

FIG. 8, the same detail as that of FIG. 7, but once the jaws are closed so that the bottom is welded to the wrapper, and the entrance head of the other, a well as the separating cut between both packages.

FIG. 9-A, shows a schematic detail of the welding vetical and horizontal means, the latter sealing the bottom of a wrapping sleeve, after closing and cutting the previous package, according to the arrows.

FIG. 9-B, is the same schematic detail of FIG. 9-A, where the horizontal welding system goes down, holding the first bags inside the wrapper, as the vertical welding system gradually produces the discontinued weldings throughout the whole length of the sleeve.

FIG. 9-C, the same detail, once the filling is complete, the pile goes down according to the central lower arrow, ready to close again as it is seen in FIG. 9-A.

Figure 10:
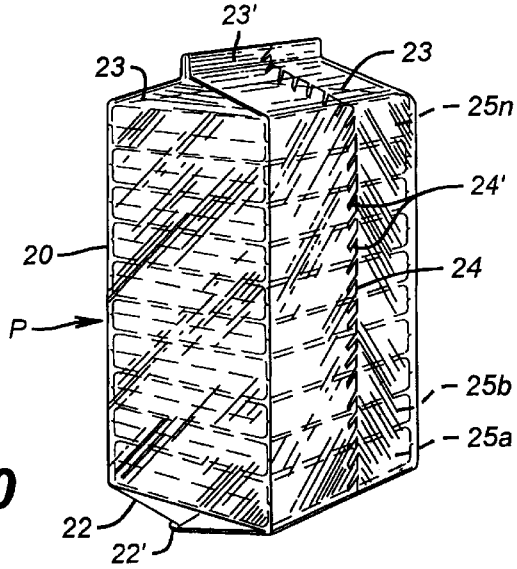

FIG. 10 is a perspective view of a package wrapping and holding a plurality of piled bags and the contents thereof; bags which have been packaged according to the new method and with the new machine described herein.

Figure 11:
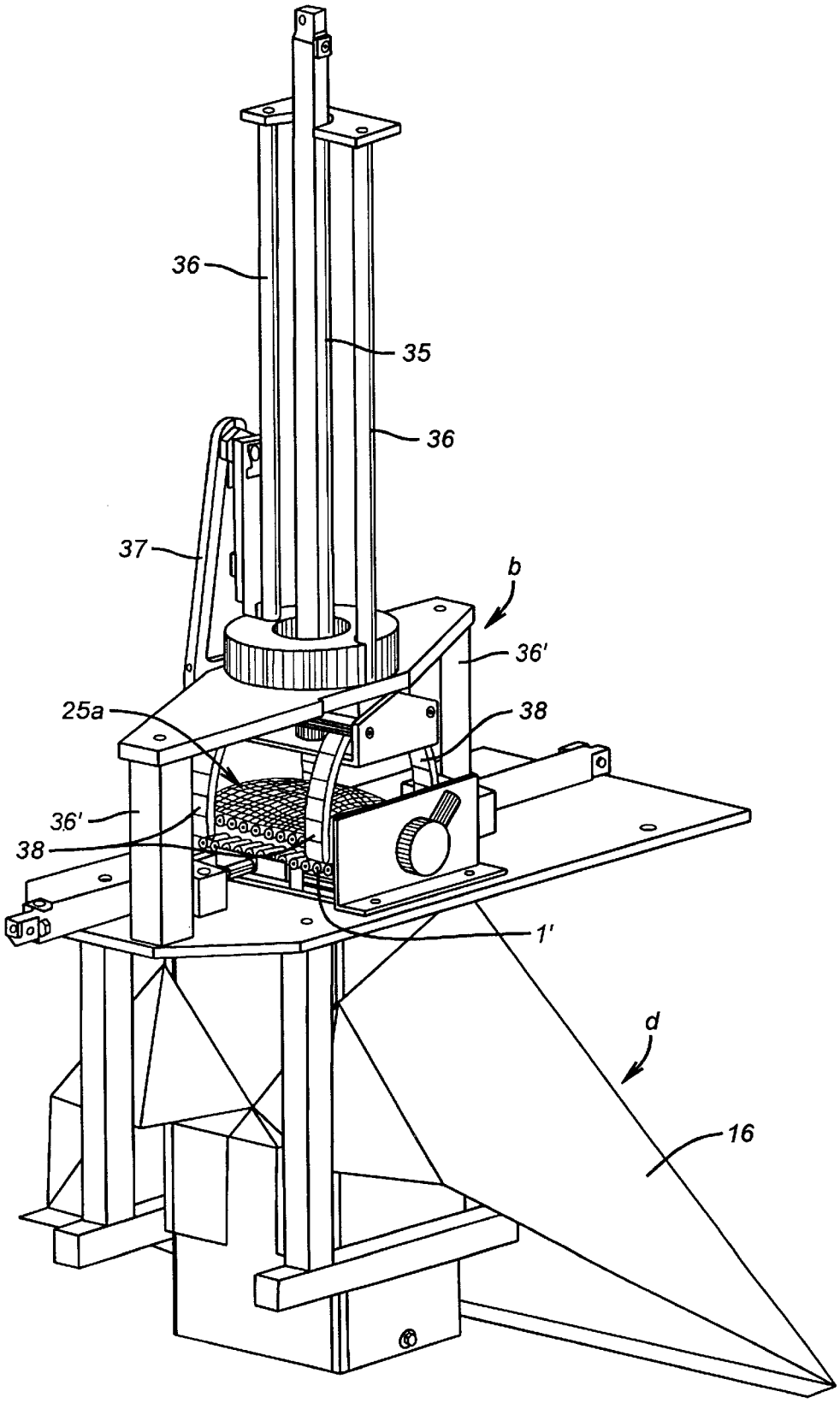

FIG. 11 is a detail in perspective of the machine in a new emobodiment of the descending system of bags, which in this case, fall in a controlled fashion, which are then taken by a a set of curved-like tweezers which take the bag without damaging it, and make it go down until it reaches the bottom (first bag), and the other bags forming the complete pile.

Figure 12:
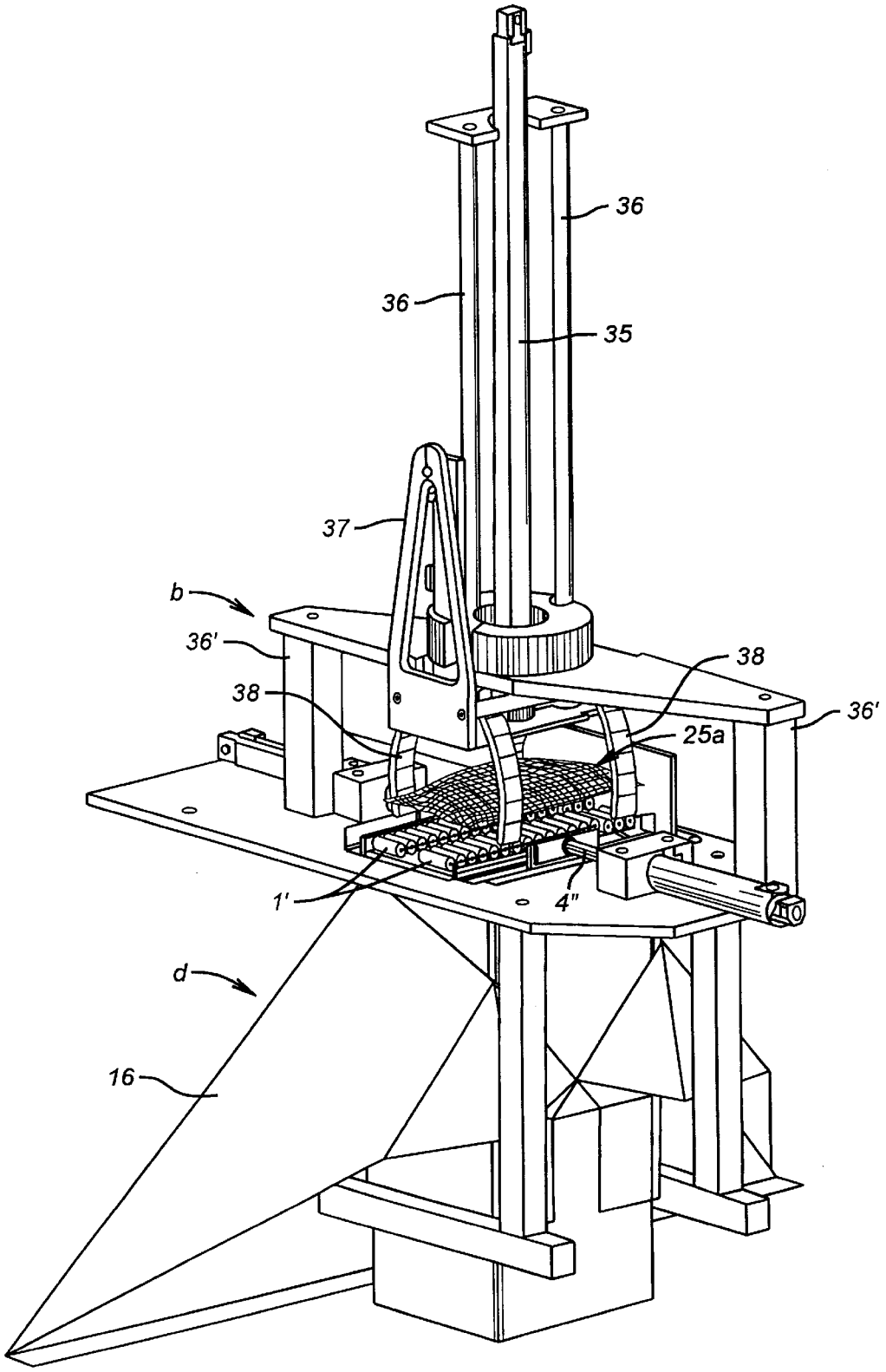

FIG. 12 is another perspective view of the same embodiment of the machine shown in FIG. 11, but shown at an angular difference of 90° with respect to the one shown in said FIG. 11; it shows the tweezers as they take a bag, and press it to adapt the shape thereof to the cavity of the wrapping.

Figure 13:
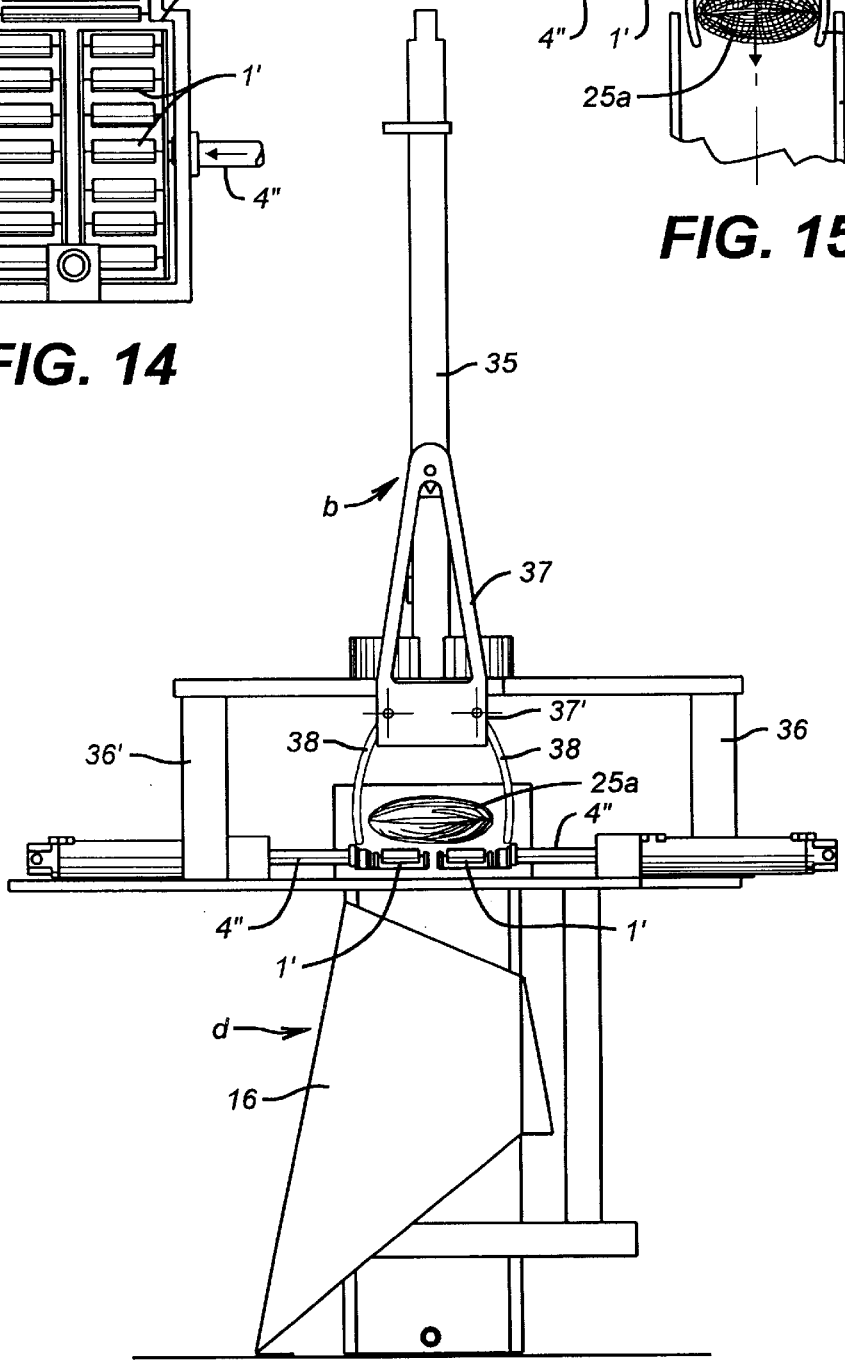

FIG. 13 is an elevation view of the same set shown in FIGS. 11 and 12, which shows the jaw-like tweezers open, and ready to take a bag as said bag enters the reception area.

Figure 14:
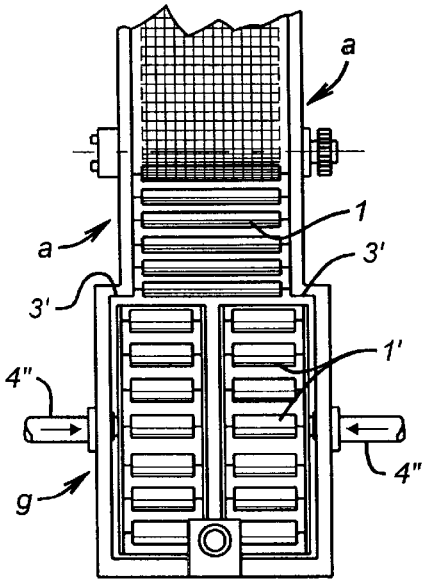
Figure 15:
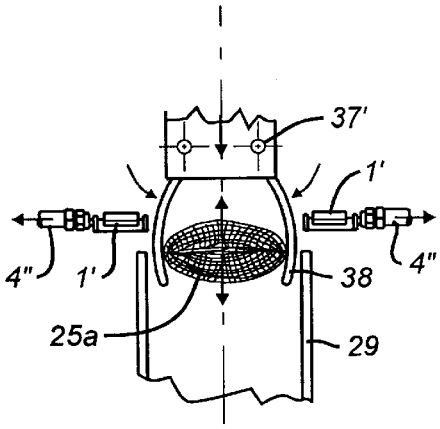

FIG. 14 is a top view of the bag transporter—feeding the filling head—which shows the framework with two back elbows as coadjutant ankles holding each bag in place, until it is taken by the jaw-like tweezers; and finally, FIG. 15 is an operative detail of the jaw-like tweezers as they introduce a bag in the wrapping cavity, as the controlling closing means separate according to the arows to enable unloading.

In these figures, same reference numerals indicate the same parts or corresponding parts, and the letters indicate sets of several elements.

Figure 1:
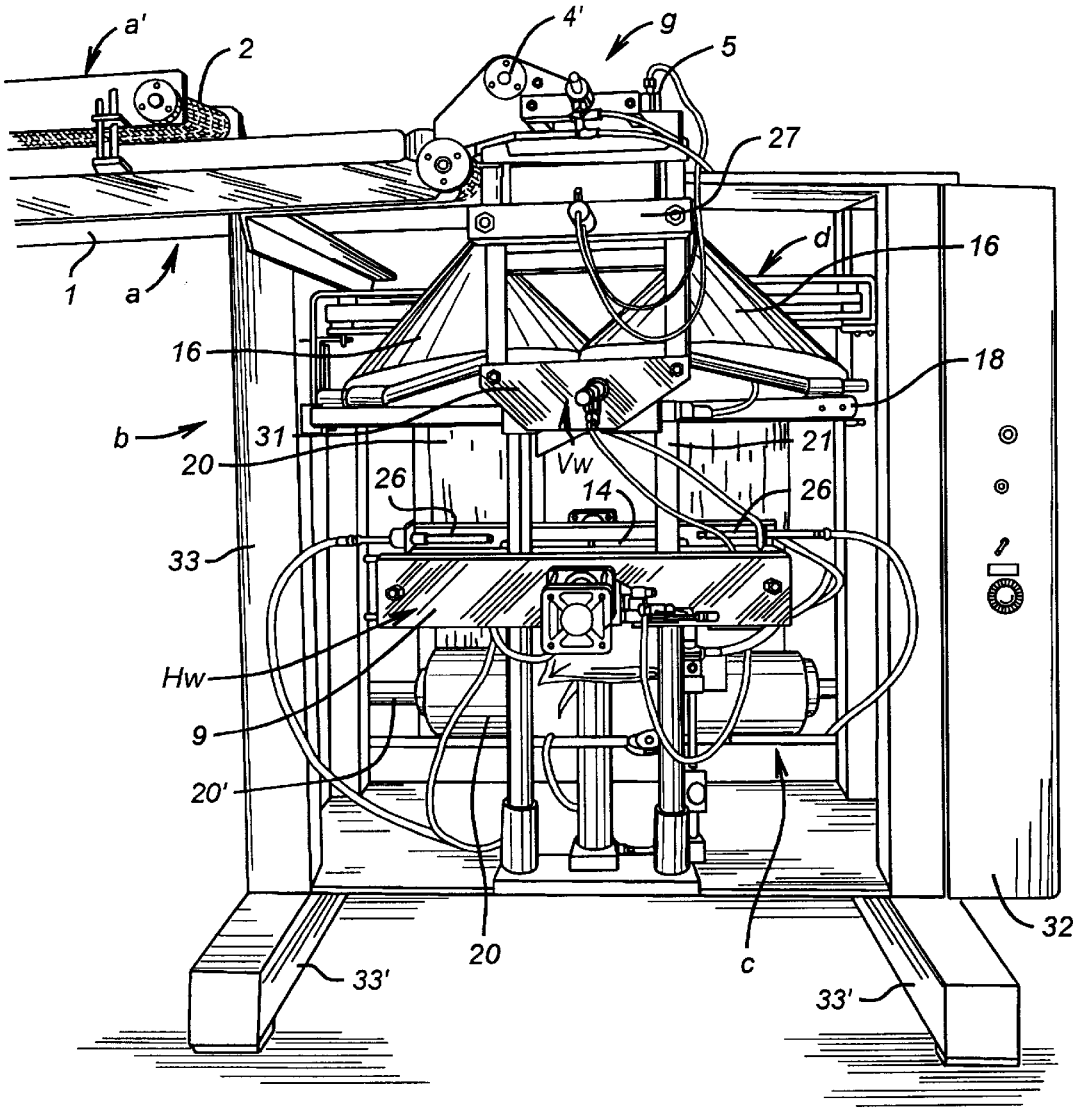
FIG. 1 shows a schematic view in perspective of the machine; in the top portion thereof the bag feeder is shown together with the compressing means of the bags and the contents thereof—top part of the figure. Also shown are the hood defining the sleeve, the braking system, the horizontal and vertical weldings, and the plastic sheet spool which shapes the wrapping sleeve.
Figure 2:
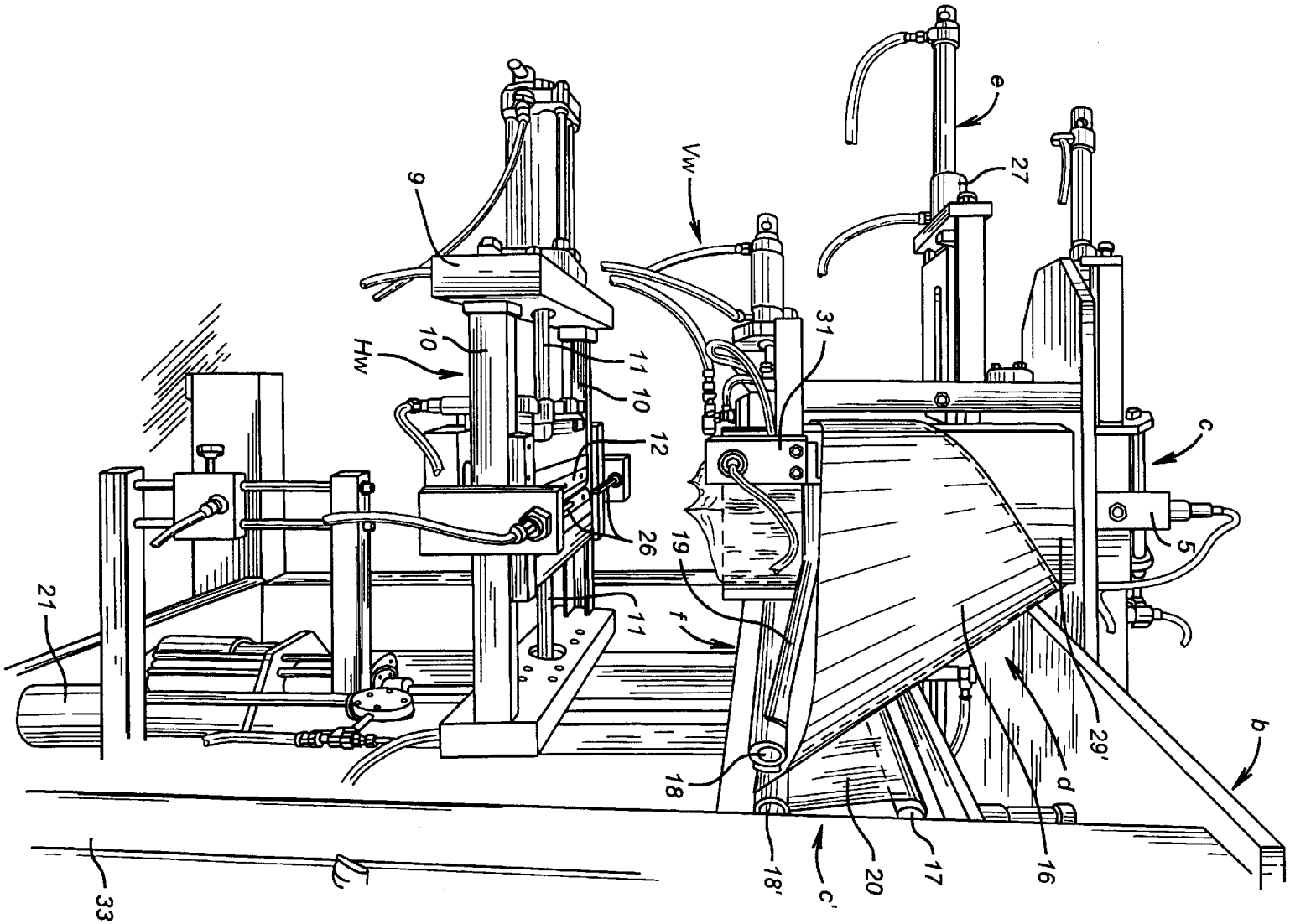
FIG. 2 is a perspective side view of the machine related to the one shown in FIG. 1.
Figure 3:
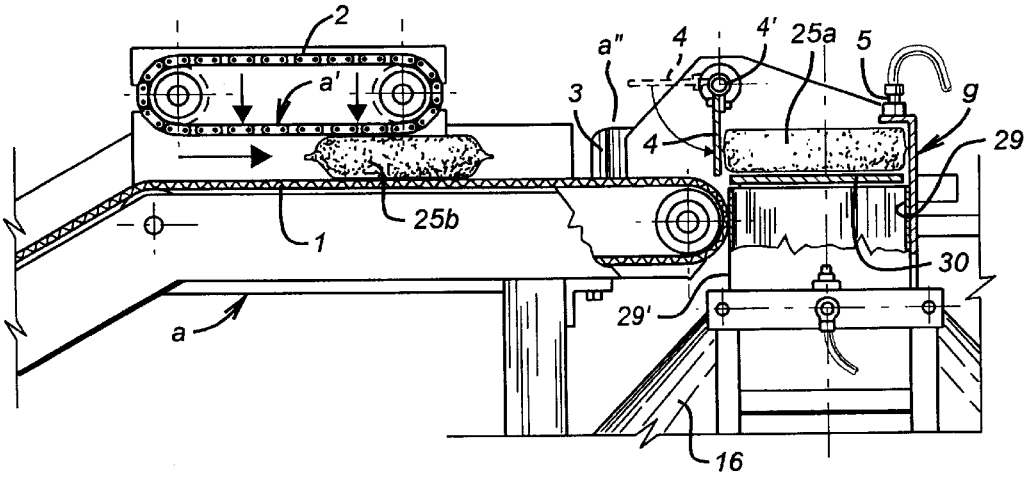
FIG. 3 is a detail of the reception box and the transporter which feeds it. The figure also shows how compression of the bags occurs so as to standarize the format thereof; also shown is the port which allows bags to enter one at a time.
Figure 4:
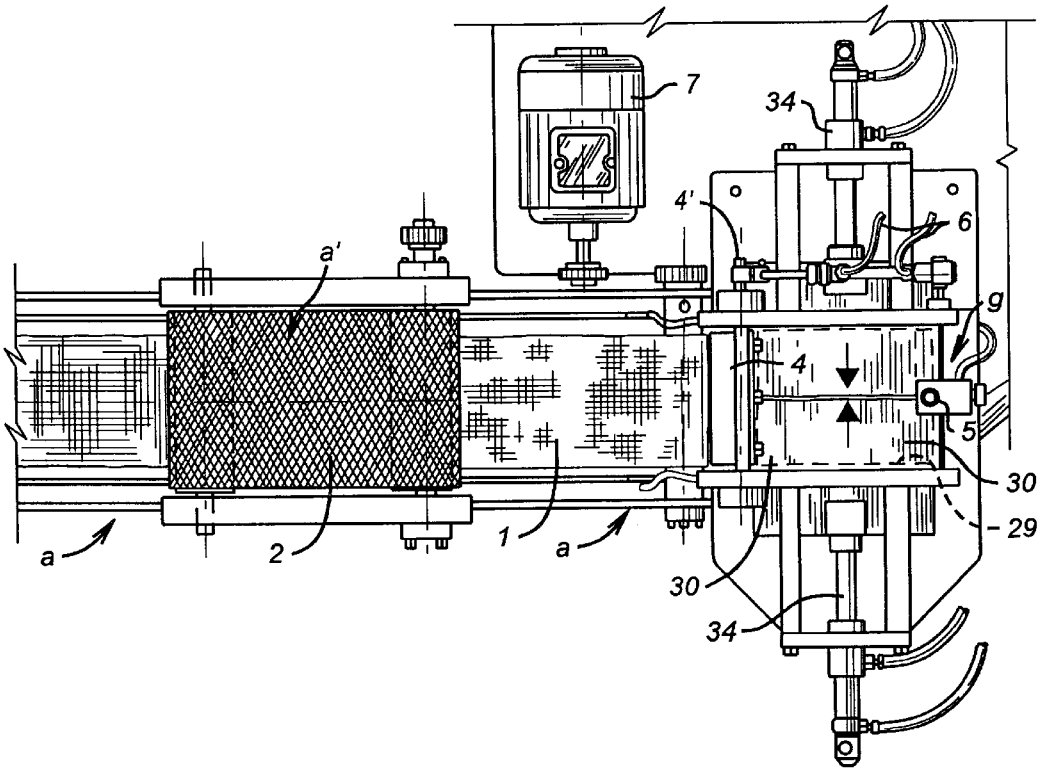
FIG. 4 is a top view of FIG. 3; the floor of said reception box can be seen in a closed position so that it holds the bag entering said box.
Figure 5:
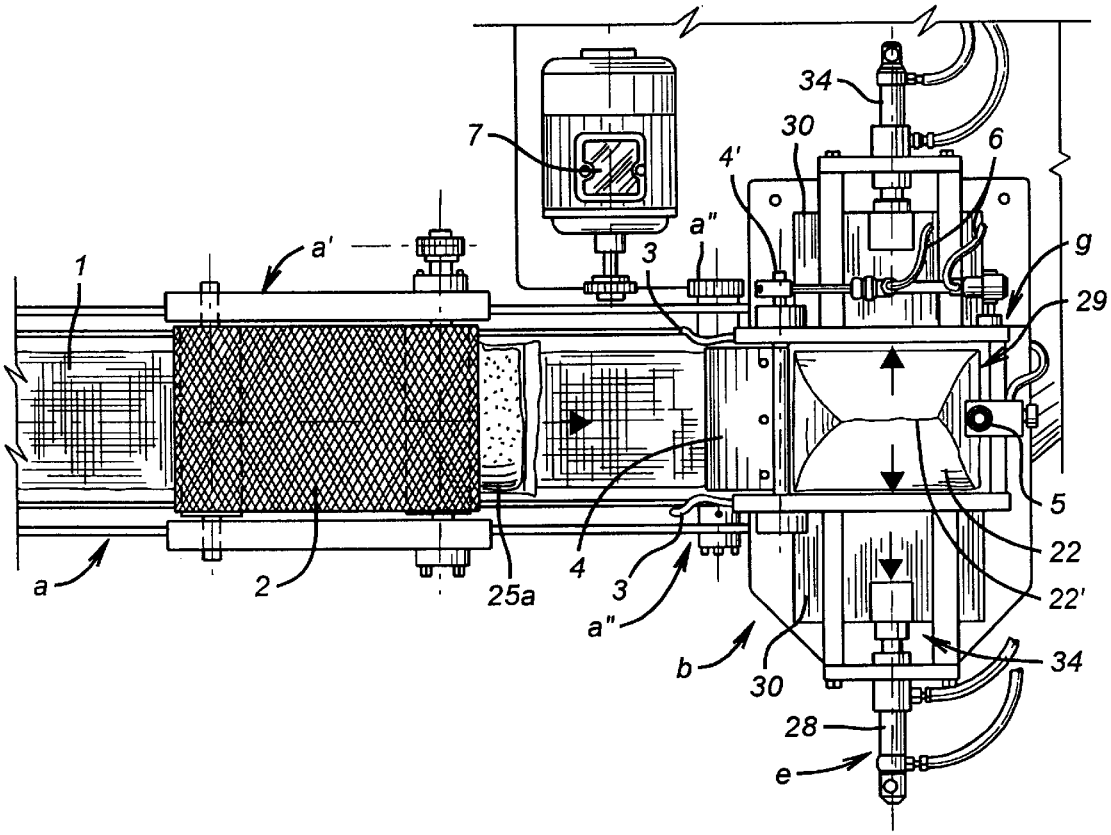
FIG. 5 is another view like FIG. 4, but once the floor (bottom of the box) has been displaced so that the free fall of the box occurs.
Figure 6:
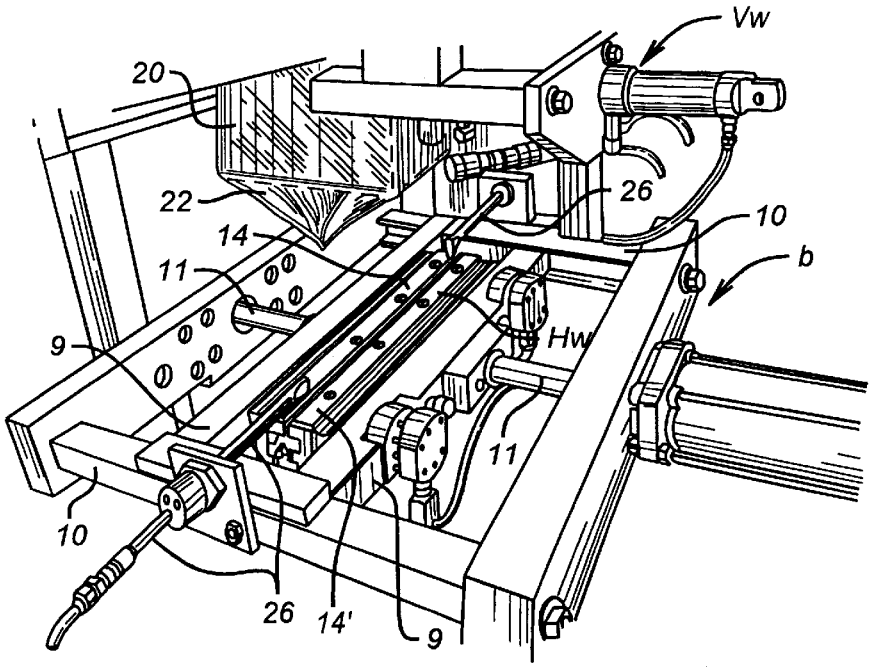
FIG. 6 shows another detail of the machine related to the vertical welding means and, below, the horizontal welding means; showing how the wrapper is shaped once it is welded to the bottom thereof and defines the bellows which allows it to either fold or retract.
Figure 9C:
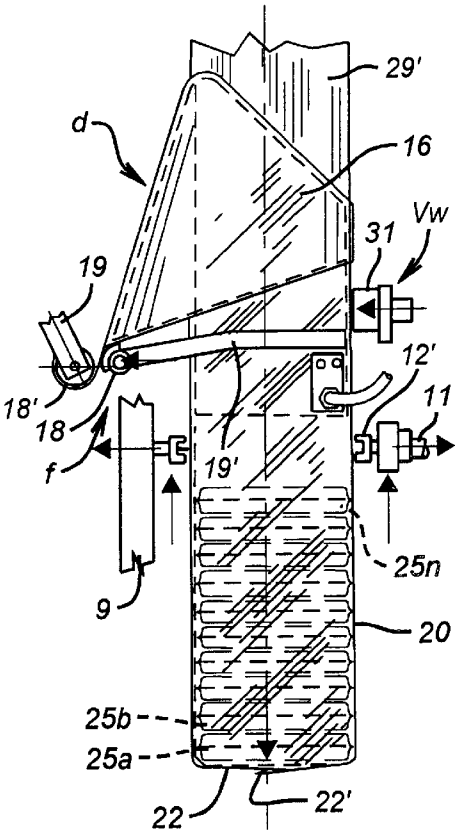
Figure 9B:
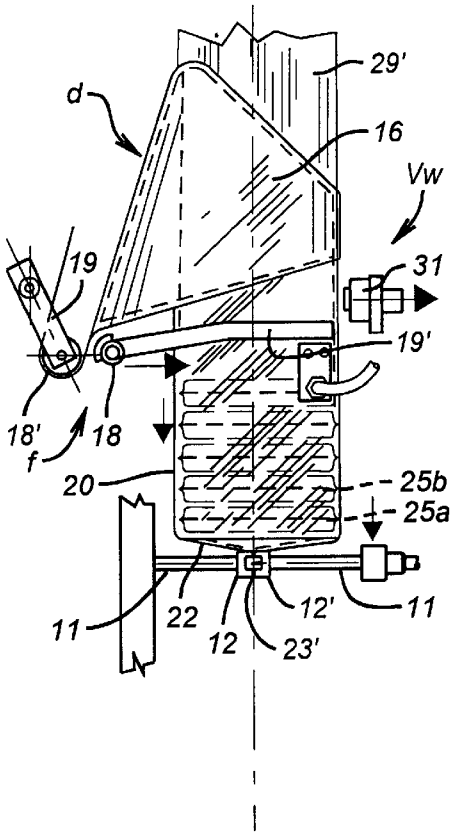
Figure 9A:
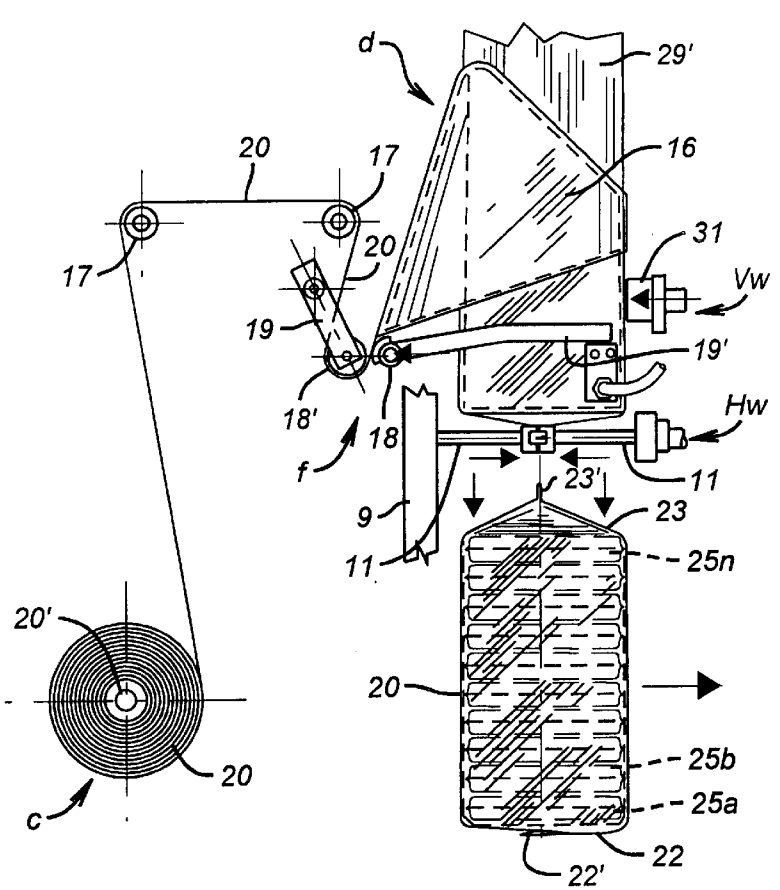

LIST OF PRINCIPAL REFERENCES (a) transporter (FIGS. 1, 3, 4)
(a') top bag presser (FIGS. 1, 3).
(a") side bag presser (FIGS. 3, 5).
(b) machine framework (FIGS. 1, 2, 6)
(c) sheet wrapping spool (FIGS. 1, 2)
(d) sleeve defining head (FIGS. 1, 2, 9A, 9B, 9C).
(e) braking system (FIGS. 2, 5)
(f) film guiding presser (FIG. 2)
(g) piling guide (FIGS. 4, 5)
(h) (d) driving mechanism
(p) resulting package (FIGS. 9A, 9, 10)
($H_w$) horizontal welding means (FIGS. 1, 2, 6, 7, 8, and 9A)
($V_w$) vertical welding means (FIGS. 1, 2, 6, 9A, 9B, 9C)
(1) (a) conveyor belt (FIGS. 1, 3)
(1') roll transporter (variant of FIGS. 11 through 15)
(2) (a') presser conveyor belt (FIGS. 1, 3, 4, 5)
(3) side bag definers (FIGS. 3, 5)
(3') corner elbows of (3) (variant of FIGS. 11 through 15)
(4) swinging port (FIGS. 3, 4, 5)
(4') hinging axis of (4) (FIGS. 3, 4, 5)
(4") side pushing members (variant of FIGS. 11 through 15).
(5) electric eye (FIGS. 1, 3, 4, 5).
(5') sensor (variant of FIGS. 11 through 15)
(6) pressing fluid driving circuits (FIGS. 4, 5).
(7) engine (FIG. 5).
(8) bottom welding bar for bottom wall (FIG. 7) (22)
(8') welding bar of head sheet walls (23) (FIG. 7)
(9) bar guiding wall for clamp holder bar (FIGS. 1, 2, 6, 9A, 9B, 9C) (11)
(10) tracking bars of the horizontal welding framework ($H_w$) (FIGS. 2, 6).
(11) clamp holder bar (FIGS. 2, 6, 7, 8, 9A, 9B, 9C)
(12) horizontal welding bar ($H_w$) (FIGS. 2, 7, 8)
(12') horizontal welding counterclamp ($H_w$) (FIGS. 7, 8)
(13) stretching supports in clamp (12) (FIG. 7)
(13') rigid anti-sliding counter supports of counter clamp (12') (FIG. 7)
(14) cutting blade separating the resulting packages (p) (FIGS. 7, 8)
(14') blade inlet in counter clamp (12') (FIGS. 1, 2, 3, 9A, 9B, 9C)
(15) regulating screw and welding/cutting clamp fitting (FIGS. 7, 8)
(16) hood defining of sleeve head (d) (FIGS. 7, 8)
(17) guiding roll of the wrapping sheet (20) (FIG. 2)
(18) mobile pressing jaw of film guilding presser (f) (FIGS. 1, 2)
(18') fixed rotating jaw facing mobile pressing jaw (18), of the presser (f) (FIG. 2)
(19) jointed arm, holder of mobile pressing jaw (18) (FIGS. 2, 9A, 9B, 9C)
(19') fixed arm of presser film presser (f) (FIGS. 9A, 9B, 9C).
(20) wrapping sheet (sleeve-like shaped) (FIGS. 6, 9A, 9B, 9C, 10)
(20') axis of spool (FIG. 9A) (c)
(21) displacement columns of the vertical welding system ($V_w$) (FIG. 2)
(22) sheet wall of the wrapping bottom (FIGS. 9A, 9B, 9C, 10)
(22') cross-sectional welding of wrapping (22) (FIGS. 9A, 9B, 9C, 10)
(23) head sheet wall of the wrapping (FIGS. 9A, 10) (22)
(23') cross-sectional welding of wall (23) (FIG. 10)
(24) longitudinal edges of the wrapping sheet (FIG. 10)
(24') cross-sectional discontinued seams of edges (24) (FIG. 10)
($25_a$) first package bag. (FIGS. 3, 9A, 9B, 10)
($25_b$) second package bag (FIGS. 3, 9A, 9B, 10)
($25_n$) last package bag. (FIGS. 9A, 9C, 10)
(25') contents of the bag (granules, powders, etc.)
(26) blower-shaper of the side bellows in the wrapper (FIGS. 1, 2, 6)
(27) package holder braking mechanism (FIG. 2)
(28) driving command of temporary support (FIG. 5) (30)
(29) reception bag box (FIG. 4)
(29') rigid tube aligned with bag box (29) (FIGS. 2, 9A, 9B, 9C)
(30) opening floor or temporary support of the bag in spool (c) (FIGS. 3, 4, 5)
(31) vertical welding jaws (FIGS. 9A, 9B, 9C)
(32) command keyboard (FIG. 1)
(33) frame supports in frame work (b) (FIG. 2)
(34) floor driving mechanism for support (30) (FIGS. 4, 5)
(35) upward-downward pin, clamping head holder of each bag
(variant of FIGS. 11 through 15)
(36) guiding columns-support of pin (35) (variant of FIGS. 11
through 15)
(36') bag holding head (support) (variant of FIGS. 11 through 15)
(37) bag holding head (variant of FIGS. 11 through 15)
(38) holding clamps in head (37) (variant of FIGS. 11 through 15)

III. MAIN OBJECT

According to the stated objects, the new method for the joint wrapping of bags (25) and the contents thereof (25'), is that in which bags (25), filled with a product (25'), either granule or powder product, form a pile inside a sheet, elongated wrapping (20), made of thermo-bonding plastic, whose longitudinal edges (24) define a sleeve, and which comprises a closed bottom (22) and a closed sheet head wall (23), by means of welded seams (22 and (23"); said method is characterized in that it comprises the following steps:

advancing the bags (25) lying on the transporter (a) in such a way that they are pressed evenly without exceeding the maximum volume of the contents thereof (25');

providing the first bag (25) over a temporary support (30) thereof;

partially defining the continuous sleeve-like sheet wrapping (20) around and under the bag (25*a*) with a welded bottom (22) (22');

deactivate the temporary support (30) and make the first bag fall towards the bottom (22) of the wrapper (20), so that said bag (25) and the wrapping (20) go down at the same time; and at the same time the sleeve with discontiued seams (24') is closed; being said seams produced in the longitudinal direction of one of the sides;

feeding the temporary support (30) with the next bags (25*a*) (25*b*), one at a time, so that the pile goes down until pile (p) has a set number of bags (23'), bags (25*a*), (25*b*) (25*n*) wrapped by the sleeve (20);

welding in a cross-sectional fashion (23') the head sheet wall (23) of wrapping (20), as well as the bottom (22) of the next wrapping (20), and cutting the resulting package (p) by means of a cut (14) in the clear band occuring between both weldings (23') and (22').

DESCRIPTION

In general terms, the method in question, for the joint wrapping of bags (25) and the contents thereof (25') is that in which bags (25), filled with a product (25'), either granule or powder product, form a pile inside a sheet, elongated wrapping (20), made of thermo-bonding plastic, whose longitudinal edges (24) define a sleeve, and which comprises a closed bottom (22) and a closed sheet head wall (23), by means of welded seams (22') and (23'). The method in question is characterized in that it comprises the following steps:

1. advancing the bags (25) lying on the transporter (a) in such a way that they are pressed evenly without exceeding the maximum volume of the contents thereof (25');
2. before entering the piling track, and as each bag advances, each of them undergoes an even pressing without exceeding the maximum contents thereof (25'). This so-called "pressing" is simply performed by pressing over and under each bag, in order to produce an even "re-arrangement" of the particles of the product in question, so that the bags have a more or less standard shape and volume compatible with the shape and capacity of the piling track (g) fed by transporter (a) (FIGS. 1 through 6);
3. place a first bag (25)—identified as (25*a*)—over a temporary support (30) thereof (FIGS. 3 through 5); such that while bag (25*a*) is on said support (30), it is temporarily over bottom (22) of wrapper (20), so that welding means ($H_w$) close said bottom (22) by means of a cross-sectional welding seam (22') (FIG. 9-A).
4. partially defining the continuous sleeve-like sheet wrapping (20) around and under the bag (25*a*) with a welded bottom (22) (22');
5. deactivate the temporary support (30) (FIG. 5) and make the first bag 25*a* go down towards the bottom (22) of the wrapper (20), so that the bag (25) and the wrapping (20) go down at the same time; and at the same time the sleeve 20 with discontinued seams (24') is closed ; being said seams produced in the longitudinal direction of one of the sides; discontinued seams (24') can be oblique in relation to the the longitudinal edges (24) of sheet (20), to facilitate the operation as the set falls through gravity, as it can be seen in FIGS. 9 and 10.
6. feeding the temporary support (30) with the next bags (25*a*) (25*b*), so that the whole pile goes down together with the set (FIGS. 9-B and 9-C) until package (p) has a set number of bags ($25_a$) ($25_b$) ($25_n$) wrapped by the sleeve (20);
7. stopping the joint fall of the set, and closing by means of a cross-sectional seam (23') the head sheet wall (23) of full sleeve (20) (FIG. 9-A) as well as the bottom (22) of the next wrapping (20), and cutting the resulting package (p) by means of a cut (14) in the clear band occuring between both weldings (23') and (22').

In conclusion, there is available an extremely compact package (p), in a wrapping fashion around a pile of bags (25) with the loads thereof (25'); whose bottom and top portions (22) and (23) are closed and comprising cross-sectional seams (22') and (23') all along its length; the sleeve is closed by overlapping the longitudinal edges (24) by means of said seams (24'), (FIG. 10).

As for the machine which can be used to carry out said process, it comprises a vertical frame (b), which in the top portion has a piling track (g), fed by a transporter (a) with bags (25) containing granules, powders, etc. (25'), comprising a presser (a') of said bags (25) (FIGS. 1, 2,3, 4 and 5). In a lower level, and aligned with the reception box (29)—a part of said piling track (g)—there are mounted a braking system (27), wrapping (22) sleeve-defining head (d), the system of horizontal welding means ($H_w$), the system of vertical welding means ($V_w$) and the spool (c) with all the feeding system of the wrapping plastic sheet (22) (FIGS. 1 and 2).

More particularly, and as it is shown in the figures, frame (b) is a unit comprising two large supporting columns (33) on a base or legs (33') supporting the whole gear, to which the tracking bars (10) are attached; said tracking bars support clamp holding bars (11) (12) and (12') of the horizontal welding system ($H_w$) (FIGS. 1 and 2), as well as the axis (20') of spool (c) with plastic sheet (20), the guiding rolls (18), the sleeve-defining head (d), and other mechanisms and devices, driven by one or more engines 97) through speed reducers, movement transmitters, etc., which will not be described in detail as they are not relevant to this specification, and can be embodied in many different ways.

Transporter (a) can be a belt or continuous strap (1), and over it there is provided another smaller belt (2), whose wheels rotate in a direction contrary to that of transporter (a), which therefore produces an advance towards the piling track system (g).

The distance separating both belts (1) and (2) from transporters (a) and (a') is such that bag (25) fits tightly between said belts, and therefore it undergoes pressing in order to rearrange the particles of product (25') to make it more compact and even. In order to complement this transporter (a), at the entrance of the piling track (g), the sides of said transporter (a) comprise protruding pressing arms or fins (3), which level off the bags (FIGS. 3, 4 and 5).

It is to be noted that this so-called "pressing" of bags (25) must be enough so as to enable the rearrangement of contents (25') in more compact and even fashion, without breaking the bag, so that the size and volume of each bag (25) are compatible with the capacity and shape of the cavity of the reception box (29), where they fit.

As mentioned above, transporter (a) advances in a uniform lineal fashion and reaches box (29) which is a part of piling track (g).

According to FIGS. 2 and 5, this box comprises a frame with four walls built over the containment plane of the top portion of belt (1), defining a cavity which is compatible with the shape and size of each bag (25) pressed and arranged by superior and lateral pressing means (a) and (a") respectively.

The top portion of said box (29) is open, whereas the bottom portion is temporarily closed by a floor (30) comprising two planks which define complementary and co-planar semi-floors; by means of a mechanism (34) said planks connected to a circuit of pressure fluid (hydraulic, pneumatic, etc.) and in answer to a sensor or electric eye command (5), produce the alternating displacement of said floor (30), between two positions : one of them including facing edges of the semi-floors in contact or as near as possible, supporting bag ($25_a$) temporarily once it has entered (see FIGS. 3 and 4), and another which causes the retraction displacement of floor (30), which is deactivated in this way (FIG. 5), enabling the discharge of said bag through the sleeve defining head (d).

Likewise, the front wall of the box frame (29), is mobile and defines a swinging port (4) with a hinging axis (4'). Every time said port (4), which is also commanded synchronously by electric eye (5), opens (FIG. 5, and FIG. 4 , dotted line), it allows a bag (25) in the cavity of the reception box (29), whereas every time it closes, it prevents any other bag from entering the cavity until unloading has occurred (FIG. 4).

There is a rigid tube (29') under said box (29) and aligned with it, surrounded by a sleeve defining head (22), which is a plank folded in a hood-like manner (16) as can be seen in FIGS. 1, 2 and 9.

The polyethylene sheet (22) advances towards said definer (d). Said sheet goes from a spool (c) rotating around a lower axis (20') and through guiding rolls (17), fits a mobile rotating jaw (18')—assembled on a joint arm (19)—and a rotating jaw (18) assembled in the end of a fixed arm (19').

Between both jaws (18) and (18') there is provided a stopping presser (f) of sheet (22), which keeps said sheet tight over hood (16) on which it goes up, and finally goes up on the rigid tube (29') (FIGS. 2, 3 and 9).

Below rigid tube (29') there is provided a system of horizontal welding means ($H_w$) which—as can be seen in FIGS. 1, 2, 6, 7 8 and 9—comprises welding clamp-holding (12) and (12') bars (11) for welding and cutting, said bars are guided in walls (9) and punched to that effect. Moreover, said jaw system of $H_w$ is completed by means of two opposite blowing nozzles (26) which after going through the sleeve (20) in the area next to the backwall welded in (22') form the lateral bellows which form in turn a plane base (FIGS. 1, 2 and 6).

As can be seen in FIGS. 7 and 8, both the clamp (12) and counterclamp (12') are U-shaped pieces made of bronze, cooled by air flow and facing each other by means of their free arms which end in stretching supports (13)—made of synthetic rubber resistant to temperature—and the antisliding rigid counter supports (13') (FIG. 7), whose function is to keep the polyethlene sheet (22) in place during welding and cutting.

Inside each "U" of the clamps 12 and 12', there is provided a steel piece on which nichrome straps are assembled , which are responsible for the lower (22') and superior (23') weldings; in the intermediate central part of the system there is provided an especially sharpened cutting blade (14) which can be placed in an opposite inlet (14'), and is responsible for separating packages (p) and cutting the resulting strip between the consecutive weldings (22') and (23') (FIGS. 8 and 9-A). The above mentioned straps are fixed at one end on an insulated head, while the other end is fixed to a sliding head with springs which keep the strap tight and prevents it from becoming loose, and at the same time, the dilation thereof is offset when it becomes hot.

Both straps are covered by a low friction, synthetic resin or Teflon® (available from E. I. Du Pont de Nemours) layer so as to avoid sticking with the polyethylene during the sealing process.

It should be observed that this piece can slide thanks to a cylider whose pin (see FIG. 7, left jaw) pushes the blade-holding piece (14) to seal and cut the polyethylene. (20).

Besides, at least one of these jaws (12) can include a regulating screw (15) employed to adjust the welding and cutting jaw to secure the perfect operation of the sets ($H_w$), FIGS. 7 and 8.

This set ($H_w$) slides not only with horizontal alternating movements of the jaws thereof (12) and (12')—for closing or opening, whatever the case may be—but also with upward-downward movements according to the the vertical geometrical axis of the machine guided in a system column (FIGS. 1 nd 2); so that the horizontal welding means ($H_w$)support several bags ($25_a$) ($25_b$) apart from forming seams (22') and (23'), etc. (FIG. 9-B), going down at the same time and gradually as the bag falls, until the load is complete 9 FIG. 9-C). During this gradual fall, the braking set (e) together with the means (27) (sic) Definer (d) shaped the polyethylene sleeve (20) which, on closing laterally makes the areas next to the longitudinal edges (24) slide between jaws (31) of a system of vertical welding means ($V_w$) which in turn produce cross-sectional, discontinued and oblique seams (24') every time the machine stops, and as far as it advances (FIG. 10).

In the embodiment shown in FIGS. 11 through 15, the machine is structured in an analogous way, except for the bags exit (25), which instead of being discharged through gravity, is carried out by means of a holding head (37). In fact, according to FIG. 14, transporter (a) is in this case, roll-driven , and delivers bags (25) in the reception area where the piling track (g) is provided, said area is surounded by the gate or reception box (29).

In this embodiment, definers (3) are not necessary as the bag (25) enters the box (29) directly, which is wider than the rest of the transporter (a) (FIG. 14) and where therefore the cornering elbows (3') are provided.

Over the piling track (g) there is provided a vertical pin (35) slidingly guided between columns (36) of a frame (36') with controlled upward-downward movements in relation to the roll floor (1')

A holding head (37) is fixed to said pin (35)—FIGS. 12 and 13—and in the lower part there is assembled a set of curve-like tweezers (38) which form a small pressing clamp for the bags (25), in an open position (for example, by means of springs which are not shown); but arranged in the area near the two pushing members (4")—comprising pneumatic sliders or similar—facing one another (FIGS. 11 through 15). Said pushing members (4") are horizontally arranged (FIG. 13), and function according to the set of rolls (1') aligned in two lines (FIG. 14) thereby forming an open floor.

Below the opening of said floor (1'), there is provided a definer head (d) of the sleeve formed by sheet (20); this part is similar to the embodiment described in first place. In the lower part of the structure there is provided a sensor (5').

The system works as follows:

As transporter (a) advances, bags are forced to pass between the straps thereof (1) and (2) and the superior presser (a'), as arms (3) of the lateral presser (a') standarize the sides and folds of said bags.

Before this, the sleeve has closed along the back wall thereof (22), and with the welding seam (22') (FIG. 9) and the set ($H_w$) supports the pile of bags to be loaded (at least, half this pile, after which, as this pile is held by brake (e) it goes up to support the second half.

The first bag (25*a*) pressed in this way, with port (4) open and floor (30) closed (FIG. 4), enters the cavity of box (29), and the front edge of the bag (according to the direction in which it advances) drives sensor (5) which in turn closes the port (FIG. 3), so that the next bag does not get stuck.

Then, said electric eye (5) produces the retraction of back (30) commanded by mechanism (34), so that bag (25*a*) because of its own weight falls through a rigid tube (29') until it reaches closed bottom (22) of wrapper (20).

Because of the weight of bag (25*a*), and as a brake (e) is deactivated by the action of a sensor, the bag (25*a*) and the wrapper (20) fall together; then the vertical welding produces the first cross-sectional discontinued oblique seams (24") along the overlapping edges (24). The intermediate sensor operates through the shadow of the bag: when the bag passes by, the brake (e) which holds the set firm is activated; when the bag has passed, the brake is released and the whole set can go down.

Then, port (4) is open again by the action of the sensor, so that the second bag (25*b*), already pressed, enters reception box (29). In this case, and the following cases, floor support (30) is not necessary—said floor is not activated until package (p) is ready—as the next bags 25*b* to 2*n* fall and are held by bottom (22) and by the clamps of the closed horizontal sealing system.

As each bag (25) enters to complete the pile, the set goes on descending proportionally so that the vertical welding and the seams mentioned above produce the longitudinal edge of wrapper (20).

The process is repeated until package (p) is complete, and a final portion of the wrapper is left with a neck of a certain length; then the double seam is produced: one reference (23') in the laminar head walls (23) is used to close the resulting package(p); and the other, reference (22') is used to to close the back walls (22) (FIGS. 9A, 9-B and 9-C); while at the same time, the cutting blade (14) on closing against (14') in the intermediate area between said seams (22') and (23') produces the cut separating package (p), FIG. 9-A, and package (p) is left as shown in FIG. 10 of the drawings illustrating the invention.

In the embodiment of FIGS. 11 through 15, the machine is equal to the first embodiment except for the transfer area of bag (25)—which is the one shown in said figures—between transporter (a)—as from piling track (g)—and the inside of laminar sleeve (20).

When bag (25)—which is expanded with its corners retracted in (a)—reaches reception area in (g), as it is wider the corners expand; so that bag (25) advances until it reaches the front wall of (g), and then expands as a stop, against corners (3'); so that each bag is self held inside the frame of (g).

Under these circumstances controlled by electric eye (5), bag (25) is taken by tweezers (38) which close (FIGS. 1 through 13 and in particular, FIG. 15) and deforms, as the liquid or particle contents thereof rearrange.

To produce this closing, pushing means (4") act (FIGS. 11, 12 and 15), until the size of bag (25) is compatible with the cavity of the sleeve (20).

Then, the floor of rolls (1') is open, and head (37) of tweezers (38) goes down through opening (20) until the bag is left on the bottom thereof; and then one bag on top of the other until a complete pile is formed.

During this process, the whole set goes down as described above and as it is shown in the sequence of FIG. 9; once the pre-set number of bags is reached, lower sensor (5') enables the closing and cut explained above, shown in FIG. 9A.

Though the invention has been described with respect to certain embodiments thereof, it is obvious that equivalent alterations and modifications will occur to those skilled in the art upon reading and understanding the specification. The present invention is limited only by the scope of the claims without departing from such principles.

I claim:

1. A method for the joint packaging of bags filled with a particle, powder or granule product, to form a pile of the bags inside a wrapping formed from an elongated laminar sheet of thermo-bonding plastic, the wrapper being sealed along a longitudinal seam thereof forming a sleeve having bottom and head walls which are closed by means of weldings comprising the steps of:

advancing bags lying on a transporter;

pressing the bags evenly to a standard shape and volume;

providing a first bag over a temporary support thereof;

forming the laminar sheet into the sleeve under the bag;

providing the sleeve with a welded bottom;

deactivating the temporary support to make the first bag fall towards the bottom of the sleeve;

causing the bag and the sleeve to descend at the same time;

closing the sleeve by sealing the longitudinal seam as the bag and the sleeve descend;

sequentially feeding additional bags atop the first and suceeding bags to increase the pile of the bags in the sleeve until the pile has a set number of bags wrapped by the sleeve;

welding a head sheet wall of the sleeve with a top seam to form a sealed package of the pile of bags within the sleeve;

welding a bottom of an adjacent portion of the sleeve at a position spaced by a strip of the sleeve above the welded head sheet wall, and cutting the strip between the adjacent weldings of the sleeve to provide a bottom for another sleeve to receive bags.

2. A method according to claim 1, further including:

longitudinally welding the sleeve along overlapping portions next to its longitudinal seam.

3. A method according to claim 1, wherein the fall of the package of the bags and the sleeve is caused by the weight of said bags as they fall inside said sleeve.

4. A method according to claim 1, wherein the fall of the bags towards the bottom of the sleeve occurs through gravity.

5. A machine for concurrently wrapping a sequence of bags filled with a particle, powder or granule form into an elongated laminar wrapping sleeve, said machine comprising:

a spool of thermo-bonding plastic sheet, with tensioning and guiding rolls;

a hood fed by the spool to define the laminar wrapping sleeve from the plastic sheet to receive the sequence of bags;

said sleeve having a lower transverse seam in a bottom portion;

said sleeve comprising a reception area for the sequence of bags;

a transporter to move the bags to the sleeve;

a sensor that allows one bag at a time from the transporter into the sleeve;

a pressing mechanism for the bags to cause the bags to have a volume compatible with the reception area in the sleeve;

said pressing mechanism being arranged on the transporter;

a sliding floor connected to the sensor to receive one of the bags at a time;

said floor being movable from a position to hold the bag to another position to allow the bag to fall into the sleeve;

horizontal welders for the bottom and head of the sleeve;

a vertical welder to join the overlapping longitudinal edges of the wrapping sheet;

said horizontal welder comprising:

two sets of thermic clamps:

a lower of the horizontal welder clamps forming a transverse seam of a head portion of the sleeve;

an upper of the horizontal welder clamps forming a transverse seam of a bottom portion of the sleeve;

cutting members to cut the sleeve above the head portion of the seam;

blowers adjacent said horizontal welder serving as a bellows for the sleeve;

the vertical welder comprising:

a set of thermic clamps arranged in a plane conforming to the overlapping line of the longitudinal edges of said wrapping sleeve;

a sliding member for the bag; and a mechanism for stopping the fall of each bag.

6. A machine according to claim 5, characterized in that, the sliding member for the bag comprises two curved tweezers assembled on a vertical support driven in an upward-downward direction as a support head for each bag; said head being kept in an open position by a tensioning mechanism.

7. A machine according to claim 6, including a closing means of the tweezers comprising horizontal collinear members, whose ends move until they reach said tweezers, and are separated by a distance which is smaller in width than the sleeve.

8. A machine according to claim 5, including a reception area for each bag adjacent the transporter, the reception area comprising a box which defines corner steps.

9. A machine according to claim 8, characterized in that the sensor located adjacent the reception area is an electric eye;

said electric eye detecting when a bag has entered said box and thereafter driving a mechanism to allow the bag to fall into the sleeve.

10. A machine according to claim 5, characterized in that the pressing mechanism for the bags comprises:

two synchronized transporters arranged on different planes and defining a tight passage for bags to rearrange the contents of the bags; and two lateral pressing arms which comprise ends adequate for fitting and standardizing the volume of the bags.

* * * * *